US005517794A

United States Patent [19]

Wagner

[11] Patent Number: 5,517,794

[45] Date of Patent: May 21, 1996

[54] APPARATUS FOR FORMING VINYL SIDING CORNERS EXTENDING OVER WALLS INTERSECTING AT OBTUSE ANGLES

[75] Inventor: Joseph R. Wagner, Bordentown, N.J.

[73] Assignee: James Michael Wagner, Edison, N.J.

[21] Appl. No.: 402,430

[22] Filed: Mar. 10, 1995

[51] Int. Cl.[6] ..... E04F 19/02

[52] U.S. Cl. ..... 52/276; 52/288.1; 52/460; 52/544; 52/547; 52/550; 52/716.1; 52/717.03; 52/717.05; 403/84; 403/110

[58] Field of Search ..... 403/84, 110; 72/176, 72/387; 33/465, 495, 471, 1 N; 52/287.1, 288.1, 275, 276, 278, 279, 716.1, 717.03, 717.05, 717.06, 60, 460, 462, 472, 522, 531, 544, 546, 550, 556, 547, 201, 273, 459

[56] References Cited

U.S. PATENT DOCUMENTS

| | | | |
|---|---|---|---|
| 280,946 | 7/1883 | Nordyke | 52/201 |
| 1,307,228 | 6/1919 | Wickstrom | 52/278 X |
| 1,664,463 | 4/1928 | Muryn | 52/550 X |
| 1,801,273 | 4/1931 | Himmel et al. | 52/204.62 X |
| 2,020,988 | 11/1935 | Balletta | 52/276 X |
| 2,230,922 | 2/1941 | Young | 52/275 X |
| 2,993,306 | 7/1961 | Persons . | |
| 3,099,051 | 7/1963 | Chenoweth | 52/276 X |
| 3,304,676 | 2/1967 | Sallie et al. . | |
| 3,321,881 | 5/1967 | Alleaume . | |
| 3,325,953 | 6/1967 | Alleaume . | |
| 3,456,702 | 7/1969 | Johnson . | |
| 3,500,600 | 3/1970 | Bagley, Sr. . | |
| 3,562,989 | 2/1971 | Gregoire . | |
| 3,651,610 | 3/1972 | Donahue . | |
| 3,670,418 | 6/1972 | Hamilton, Jr. . | |
| 3,677,322 | 7/1972 | Brorson et al. | 52/71 X |
| 3,712,003 | 1/1973 | Hallock et al. | 52/288.1 X |
| 3,717,968 | 2/1973 | Olsen et al. | 52/288.1 |
| 3,828,499 | 8/1974 | Leddy . | |
| 3,830,028 | 8/1974 | Franzese . | |
| 3,874,132 | 4/1975 | Mendelow et al. | 52/71 |
| 3,906,699 | 9/1975 | Leddy . | |
| 4,027,452 | 6/1977 | Donnell | 52/717.05 |
| 4,190,996 | 3/1980 | Schindler et al. . | |
| 4,319,439 | 3/1982 | Gussow . | |
| 4,411,120 | 10/1983 | Ellis et al. . | |
| 4,608,800 | 9/1986 | Fredette . | |
| 4,660,293 | 4/1987 | Kovacs . | |
| 4,672,788 | 6/1987 | Vantosh . | |
| 4,744,152 | 5/1988 | Roach et al. . | |
| 4,775,264 | 10/1988 | Nakamura | 52/275 X |
| 4,852,324 | 8/1989 | Page . | |
| 4,998,947 | 3/1991 | Dostall et al. | 52/287.1 X |
| 5,018,277 | 5/1991 | Frost . | |
| 5,040,400 | 8/1991 | Nastasi . | |
| 5,090,174 | 2/1992 | Fragale . | |
| 5,154,034 | 10/1992 | Stanek | 403/84 X |
| 5,311,760 | 5/1994 | Thompson . | |

FOREIGN PATENT DOCUMENTS

| | | | |
|---|---|---|---|
| 521056 | 7/1921 | France | 52/279 |

*Primary Examiner*—Carl D. Friedman
*Assistant Examiner*—Laura A. Saladino
*Attorney, Agent, or Firm*—Sperry, Zoda & Kane

[57] ABSTRACT

An apparatus for forming exterior convex vinyl siding corners for use with external walls intersecting at angles greater than 90 degrees including a vinyl siding corner member with two exterior siding members intersecting in the steady state position at 90 degrees. The exterior corner is of a flexible material such as vinyl and defines two internal slots therein within which one or more expander members is positionable to spread the exterior corner member to an angle greater than 90 degrees and approximately equal to the obtuse angle of the intersection between the first and second surfaces. The expander member may be adjustably movable to vary different angles such as would be used in the external convex corners for mounting of bay windows and other similar obtusely oriented exterior walls.

20 Claims, 5 Drawing Sheets

APPARATUS FOR FORMING VINYL SIDING CORNERS EXTENDING OVER WALLS INTERSECTING AT OBTUSE ANGLES

BACKGROUND OF THE INVENTION

1. Field of the Invention

The present invention deals with the field of exterior siding for structures having intersecting walls. In particular the present invention deals with convex exterior corner members adapted to be positioned over corners formed on the exterior of structures wherein two walls intersect at an angle greater than 90 degrees and less than 180 degrees or referred to herein as an obtuse angle.

The present invention provides a means for using exterior vinyl corner members formed at 90 degrees for covering exterior corners of greater than 90 degrees utilizing internal expanders for spreading the flexibly resilient vinyl material to achieve a smooth uniformly even exterior vinyl corner configuration. The expander members designed to be positioned internally within the slots of the vinyl corner members can be adjustable or of a fixed angular relationship such as to flex the vinyl corner outwardly to the desired obtuse angle.

2. Description of the Prior Art

Many designs have been utilized as fixtures for use with exterior vinyl siding configurations or external corner members used for forming convex corners such as shown in U.S. Pat. No. 2,993,306 issued Jul. 25, 1961 to C. Persons and assigned to Hal Roach on a "Corner Trim"; and U.S. Pat. No. 3,304,676 issued Feb. 21, 1967 to S. Sallie et al and assigned to Bird & Son, Inc. on a "Siding Construction"; and U.S. Pat. No. 3,321,881 issued May 30, 1967 to J. Alleaume and assigned to Technigaz on a "Folded Corrugated Sheet-Like Corner Piece"; and U.S. Pat. No. 3,325,953 issued Jun. 20, 1967 to J. Alleaume and assigned to Technigaz on a "Folded Corrugated Sheet-Like Corner Piece"; and U.S. Pat. No. 3,456,702 issued Jul. 22, 1969 to R. Johnson on a "Structural Holding And Aligning Fixture"; and U.S. Pat. No. 3,500,600 issued Mar. 17, 1970 to O. Bagley, Sr. on a "Trim For Shiplap Siding"; and U.S. Pat. No. 3,562,989 issued Feb. 16, 1971 to R. Gregoire assigned to Z-Lock Block Co. on "Building Blocks, Bricks, Tile, Panels And The Like"; and U.S. Pat. No. 3,651,610 issued Mar. 28, 1972 on a "Building Corner Unit"; and U.S. Pat. No. 3,670,418 issued Jun. 20, 1972 to D. Hamilton, Jr. on an "Angularly Adjustable Square Holder"; and U.S. Pat. No. 3,828,499 issued Aug. 13, 1974 to R. Leddy on a "Corner Assembly For Exterior Siding"; and U.S. Pat. No. 3,830,028 issued Aug. 20, 1974 to D. Franzese and assigned to Morgan Yacht Corporation on "Building Structures"; and U.S. Pat. No. 3,906,699 issued Sep. 23, 1975 to R. Leddy on a "Water Sealing Component For Installing Siding"; and U.S. Pat. No. 4,190,996 issued Mar. 4, 1980 to R. Schindler et al and assigned to Messerschmitt-Bolkow-Blohm GmbH on "Corners Of Structural Members"; and U.S. Pat. No. 4,319,439 issued Mar. 16, 1982 to C. Gussow and assigned to Hunter Douglas, Inc. on a "Method Of Finishing The Exterior Wall Of A Prefabricated Building And Trim Therefor"; and U.S. Pat. No. 4,411,120 issued Oct. 25, 1983 to B. Ellis et al on an "Aluminum Shingle Accessories"; and U.S. Pat. No. 4,608,800 issued Sep. 2, 1986 to R. Fredette on a "Corner Piece For Vinyl Siding Retainers"; and U.S. Pat. No. 4,660,293 issued Apr. 28, 1987 to G. Kovacs on a "Measuring Instrument For Angled Material"; and U.S. Pat. No. 4,672,788 issued Jun. 16, 1987 to B. VanTosh on a "Method And Device For Repairing Vinyl Siding And The Like"; and U.S. Pat. No. 4,744,152 issued May 17, 1988 to D. Roach et al on a "Tool For Measuring Angles On Various Articles"; and U.S. Pat. No. 4,852,324 issued Aug. 1, 1989 to G. Page and assigned to Conoco Inc. on a "Variable Angle Refractory Anchor For Connecting Surfaces"; and U.S. Pat. No. 5,018,277 issued May 28, 1991 to B. Frost on an "Angle Setting Device"; and U.S. Pat. No. 5,040,400 issued Aug. 20, 1991 to T. Nastasi and assigned to G. L. Group, Ltd. on a "Power Actuated Tool For Installing Metal Corner Strip"; and U.S. Pat. No. 5,090,174 issued Feb. 25, 1992 to A. Fragale on a "Siding System Including Siding Trim Pieces And Method Of Siding A Structure Using Same"; and U.S. Pat. No. 5,311,760 issued May 17, 1994 to M. Thompson on a "Method And Apparatus For Corner Bead Angle Enlargement".

SUMMARY OF THE INVENTION

The present invention provides an apparatus for forming vinyl siding corners extending over two surfaces normally associated with a building wall or other structure which intersects at an angle greater than 90 degrees . Most buildings have corners which intersect surfaces at 90 degrees and therefore vinyl siding corner members are normally configured having a 90 degree angular orientation for use on these perpendicular intersections.

The vinyl siding corner member is formed of a flexibly resilient material such as vinyl and includes an exterior corner member adapted to extend over the first surface and the second surface of the building upon which the vinyl siding is to be mounted. The exterior corner member includes a first exterior siding member and a second exterior siding member integral with respect to one another. Preferably the first exterior siding member is oriented approximately 90 degrees with respect to the second exterior siding member when the exterior corner member is in the steady state or relaxed condition. The first exterior siding member defines a clearance space thereadjacent between it and the first surface. In a similar manner the second exterior siding member defines additional space also referred to as the clearance space means between it and the second surface. This clearance space provides the area for positioning of an expander member for changing the angular relationship between the first exterior siding member and the second exterior siding member.

The vinyl siding corner member further includes a first attachment bracket integral with respect to the first exterior siding member and including a first attachment device to facilitate securement of the first exterior siding member to the first surface. This first attachment device includes a first flange with a first hole defined therethrough to facilitate securement of the first exterior siding member with respect to the first surface by hammering nails through the first holes into the first surface. The first attachment bracket also defines a first interior slot positioned within the clearance space and facing therein.

In a similar manner the second attachment bracket is integral with respect to the second exterior siding member and includes a second attachment device to facilitate securement of the second exterior siding member to the second surface. This second attachment device includes a second flange which defines a second hole therein to facilitate securement of the second exterior siding member to the second surface by hammering of nails through the second hole into the second surface. Furthermore the second attachment bracket includes a second interior slot positioned within the clearance space and facing therein.

To facilitate control of the angle between the first exterior siding member and the second exterior siding member the plurality of expander members are designed to be positionable within the clearance space at regular intervals approximately two feet therealong. These expander members are designed to extend into the first and second interior slots to facilitate flexing of the flexible exterior corner member in such a manner that the first exterior siding member and the second exterior siding member are re-oriented at an obtuse angle between approximately 90 degrees and 160 degrees with respect to one another in order to match the angle of intersection of the first surface with respect to the second surface of the building upon which the corner member is to be mounted.

The expander in detail includes a first arm having a first arm plate positionable extending into the first interior slot. The first arm further includes a first pivotal attachment device positioned spatially distant on the first arm from the first arm plate and defining a mounting aperture extending therethrough. The pivotal attachment device further includes a fastening aperture therein. The first pivotal attachment device also includes an alignment slot therein which is concentric with respect to the mounting aperture.

Similarly a second arm is included having a second arm plate positionable extending into the second interior slot at an obtuse angle of 90 to 160 degrees with respect to the first arm plate. This second arm device further includes a second pivotal attachment device positioned spatially disposed on the second arm from the second arm plate. This second pivotal attachment device is engageable with respect to the first pivotal attachment device to pivotally secure the first arm with respect to the second arm. The second pivotal attachment device defines an alignment ring therein adapted to extend into the alignment slot for movable engagement therewith to maintain alignment between the first arm and a second arm during relative pivotal movement therebetween.

The second pivotal attachment device further includes a mounting stud adapted to extend through the mounting aperture defined in the first pivotal attachment device to facilitate pivotal movement of the first arm with respect to the second arm. Furthermore the second pivotal attachment device includes a mounted fixedly secured to the top of the mounting stud extending through the mounting aperture to maintain engagement therebetween during relative pivotal movement therebetween between the first arm means and the second arm means for adjustment of angular positioning therebetween. During assembly the mounting stud and head can be forced through the mounting aperture. This assembly is possible since the parts of the present invention are preferably formed of flexibly resilient vinyl material.

The expander members further include a fastening device adapted to selectively and fixedly secure the first pivotal attachment device of the first arm with respect to the second pivotal attachment device of the second arm after selective adjustment therebetween to a desired obtuse angle relative therebetween such that the first exterior siding member is approximately parallel to the first surface and the second exterior siding member is approximately parallel to the second surface. This fastening device preferably includes one or more self-tapping screws adapted to extend through the fastening apertures into engagement with the second pivotal attachment device for fixedly securing the first arm with respect to the second arm after selective adjustment thereof to the desired obtuse angular relationship therebetween.

It is an object of the present invention to provide an apparatus for forming vinyl siding corners extending over a first surface and a second surface intersecting at an obtuse angle between 90 degrees and 160 degrees wherein a 90 degree convex vinyl siding corner can be flexed outwardly to any desirable obtuse angle.

It is an object of the present invention to provide an apparatus for forming vinyl siding corners extending over a first surface and a second surface intersecting at an obtuse angle between 90 degrees and 160 degrees wherein a plurality of individual expander members can be positioned within a vinyl siding corner to control the angular relationship between the vinyl siding surfaces adjacent the corner apex.

It is an object of the present invention to provide an apparatus for forming vinyl siding corners extending over a first surface and a second surface intersecting at an obtuse angle between 90 degrees and 160 degrees wherein an exterior vinyl siding corner can be expanded to angles greater than 90 degrees without twisting or distortion thereof.

It is an object of the present invention to provide an apparatus for forming vinyl siding corners extending over a first surface and a second surface intersecting at an obtuse angle between 90 degrees and 160 degrees wherein additional costs in the placement of exterior vinyl siding corners on exterior angles of greater than 90 degrees is minimized.

It is an object of the present invention to provide an apparatus for forming vinyl siding corners extending over a first surface and a second surface intersecting at an obtuse angle between 90 degrees and 160 degrees wherein maintenance of exterior vinyl siding corners is enhanced due to the increase in structural strength thereof responsive to the placement of expander members therewithin.

It is an object of the present invention to provide an apparatus for forming vinyl siding corners extending over a first surface and a second surface intersecting at an obtuse angle between 90 degrees and 160 degrees wherein labor time is saved by facilitating the formation of exterior vinyl siding corners having obtuse angles.

It is an object of the present invention to provide an apparatus for forming vinyl siding corners extending over a first surface and a second surface intersecting at an obtuse angle between 90 degrees and 160 degrees wherein a plurality of expander members can be made available at various angular relationships being predefined at, for example, 120 degrees or 135 degrees in order to facilitate formation of obtuse angles with exterior vinyl siding corners.

It is an object of the present invention to provide an apparatus for forming vinyl siding corners extending over a first surface and a second surface intersecting at an obtuse angle between 90 degrees and 160 degrees wherein an expander member can be provided which is adjustable to vary the angular relationship between the surfaces of a vinyl siding exterior corner for orientation thereof at any obtuse angle required during the placement of vinyl siding on the exterior of a building of any shape.

It is an object of the present invention to provide an apparatus for forming vinyl siding corners extending over a first surface and a second surface intersecting at an obtuse angle between 90 degrees and 160 degrees wherein speed in applying of vinyl siding to the exterior surface of a building is significantly increased.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION THE PREFERRED EMBODIMENT

Figure 1:
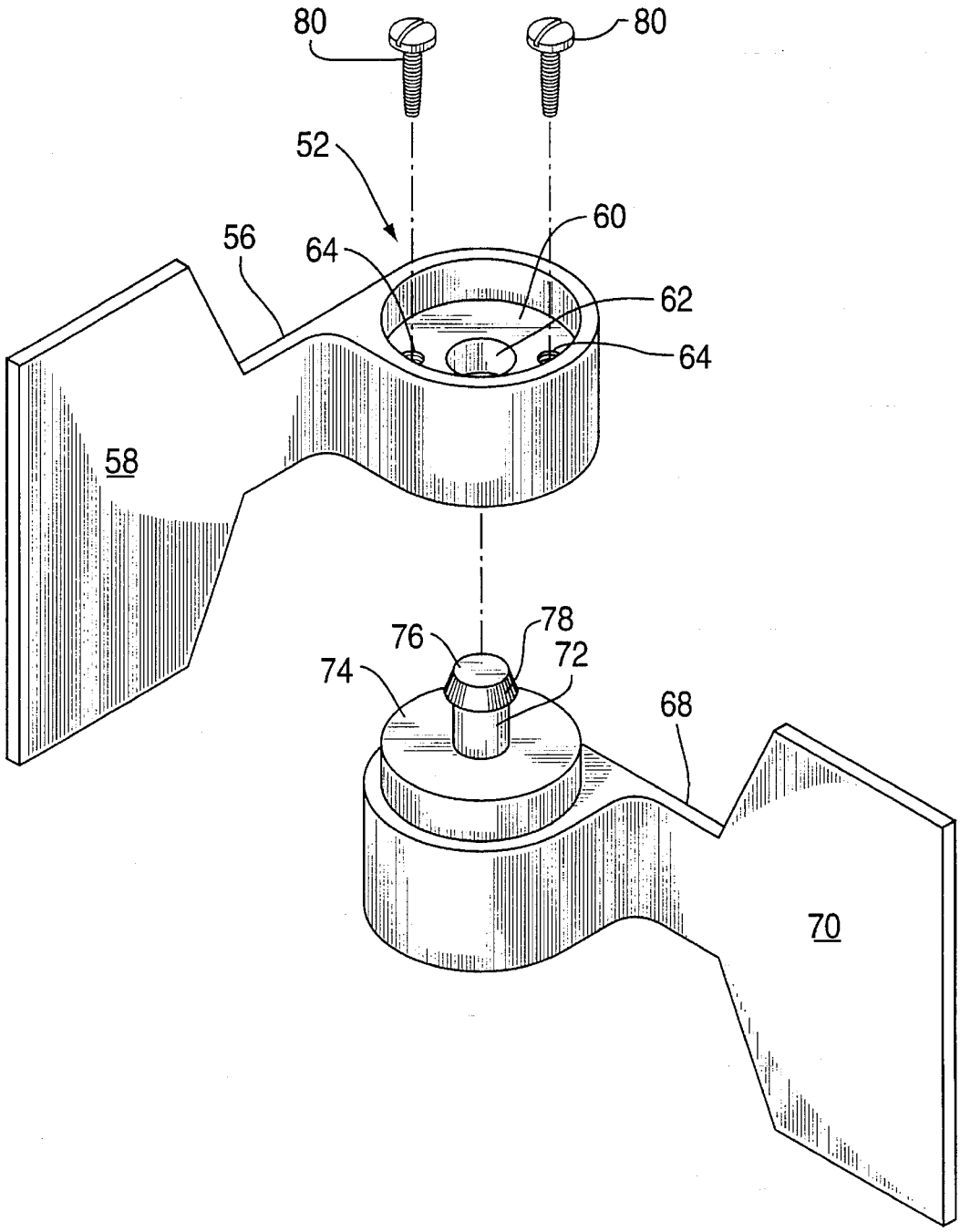
FIG. 1 is an assembly view of an embodiment of an expander member of the present invention.
Figure 2:
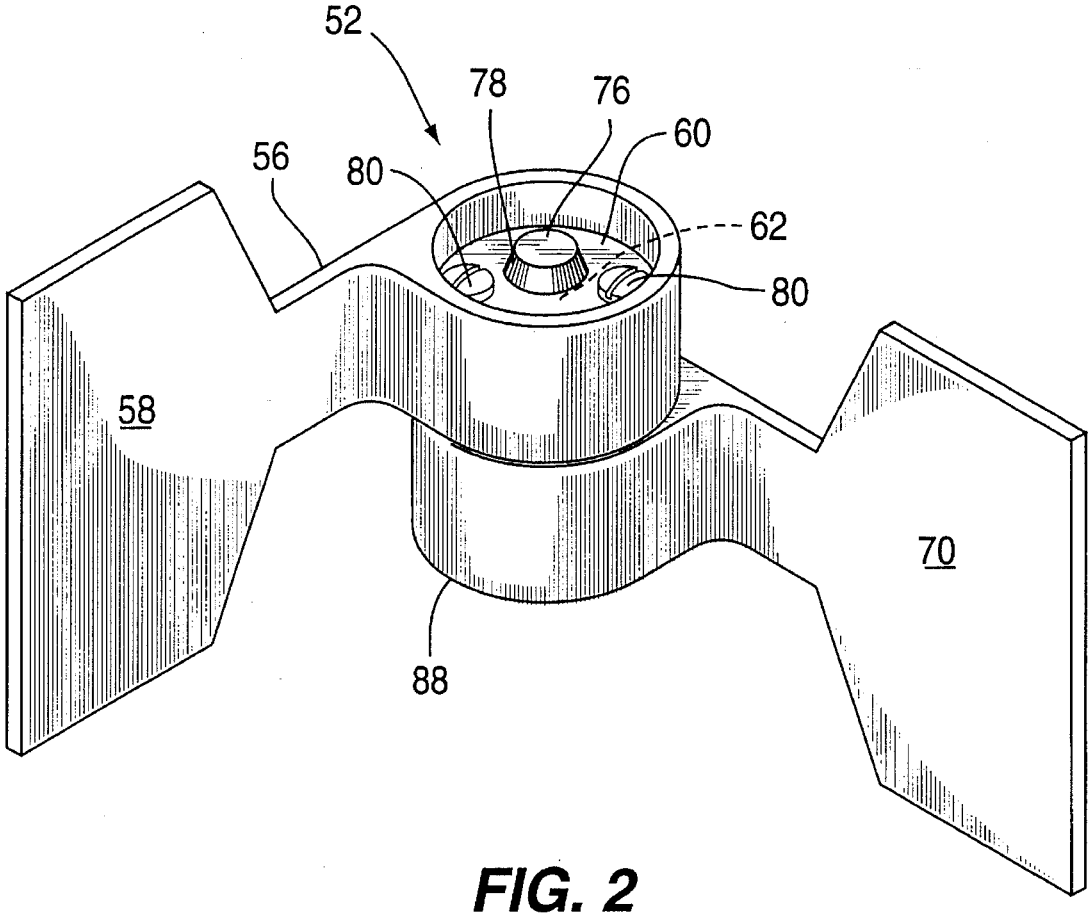
FIG. 2 is an embodiment of an adjustable expander member of the present invention.
Figure 3:
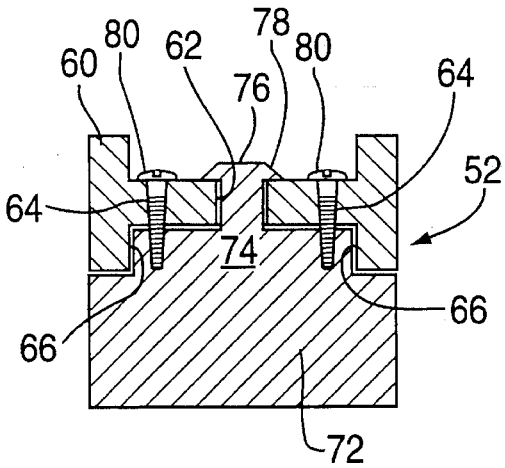
FIG. 3 is a cross-sectional view of the pivotal attachment means of an embodiment of an adjustable expander member for use with the present invention.
Figure 4:
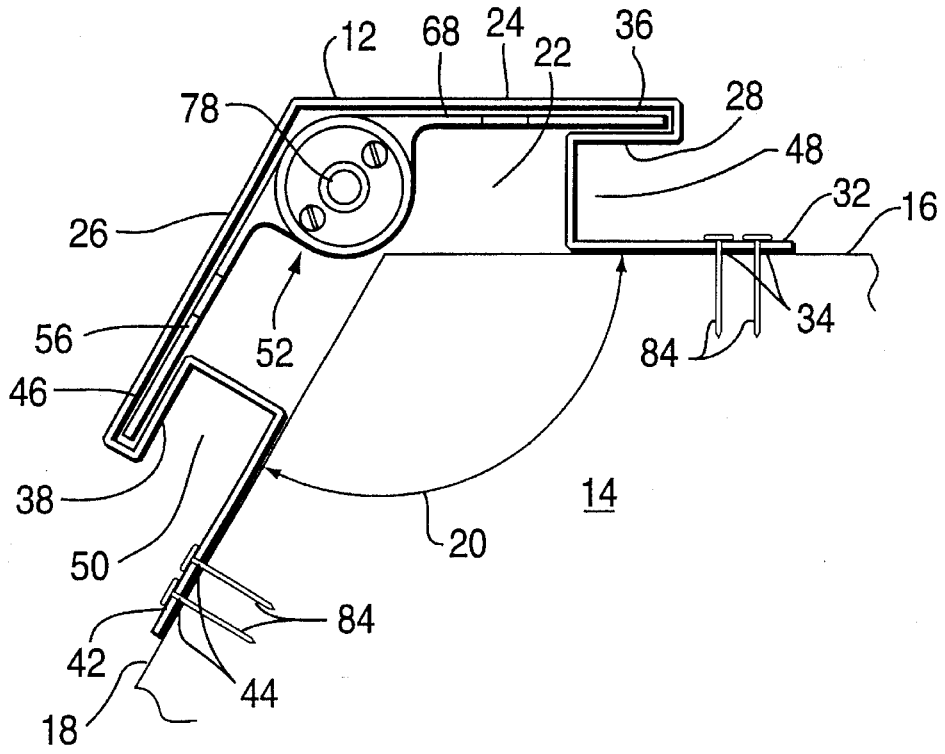
FIG. 4 is a top plan view of an embodiment of the apparatus of the present invention showing an adjustable expander member in position expanding a vinyl corner to an obtuse angle.
Figure 5:
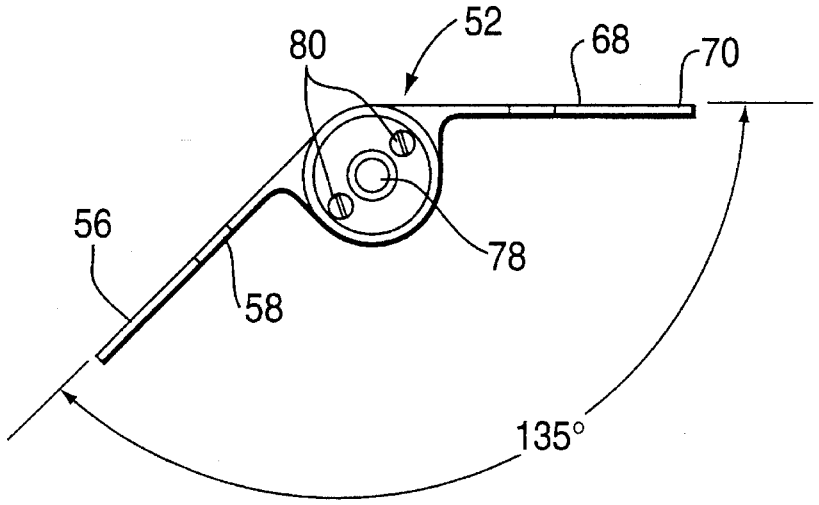
FIG. 5 is a top plan view of an embodiment of an adjustable expander member of the present invention shown set at an angular orientation of 135 degrees.
Figure 7:
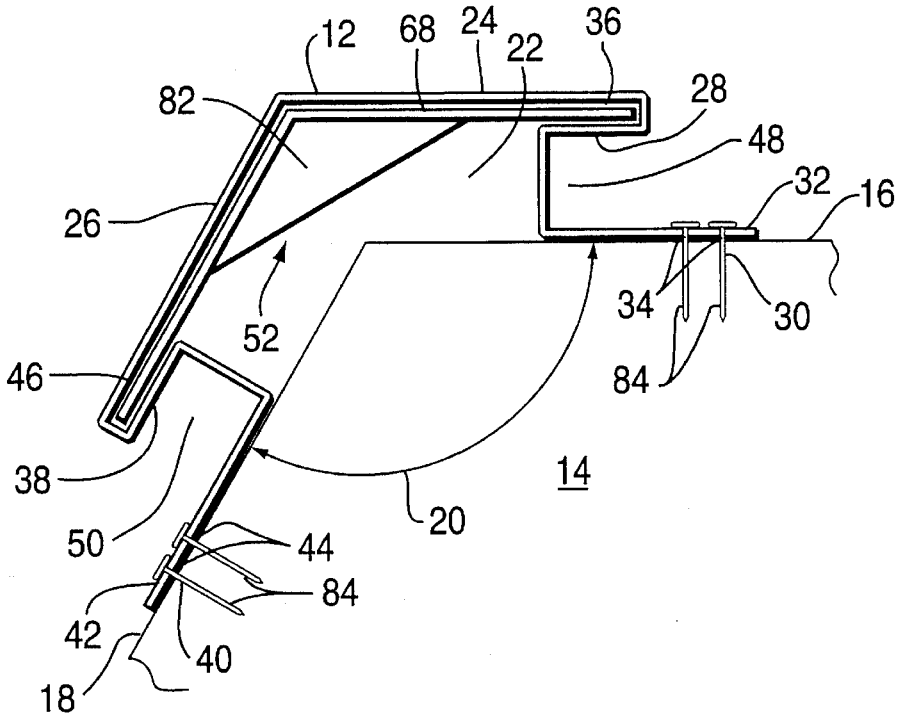
FIG. 7 is an illustration of the fixed expander member of FIG. 6 shown in position expanding a vinyl corner member to an obtuse angle.
Figure 8:
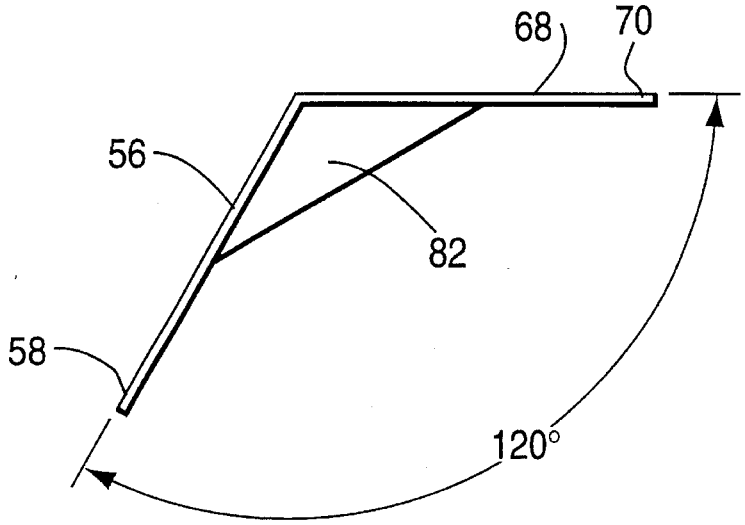
FIG. 8 is a top plan view of an embodiment of a fixed expander member shown having a 120 degree expanding angle.
Figure 9:
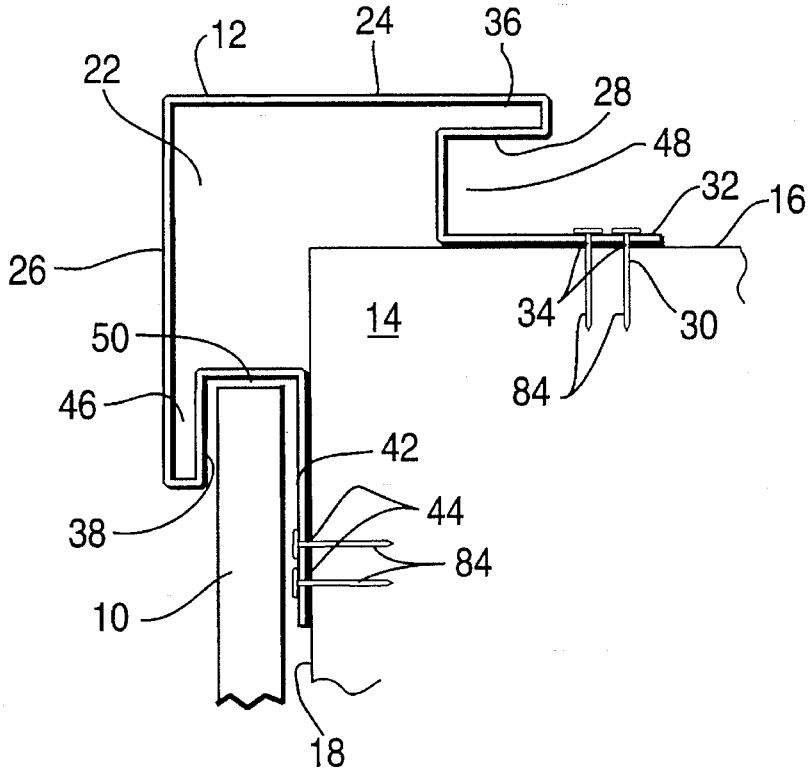
FIG. 9 is a perspective illustration of the positioning of an unexpanded corner member shown in position secured to a building with two perpendicular surfaces and also showing an embodiment of securement of the adjacent vinyl siding thereto.

The present invention provides a means for applying of vinyl siding 10 to the exterior surface of a building 14 which often includes the use of vinyl siding corner member 12 to be positioned on exterior corners. These exterior corners are formed by the intersection between a first surface 16 and second surface 18. Normally in conventional building structures the surfaces 16 and 18 are perpendicular with respect to one another. There are now several commonplace designs which utilize exterior corners wherein the surfaces 16 and 18 intersect at obtuse angles which are angles between 90 and 180 degrees. One primary example of such an obtuse angle would be a bow window where the angle of intersection of the surfaces 16 and 18 might be of any orientation greater than 90 degrees but is often either 120 degrees or 135 degrees depending on various bow window designs. The obtuse angle 20 is best shown in the configurations of FIGS. 4 and 7.

The exterior corner member 12 will preferably define a clearance space 22 immediately therewithin. This clearance space 22 is defined to be positioned between the exterior corner member 12 and the external surface of the building 14 formed by the convex intersection of first surface 16 and second surface 18.

The exterior corner member 12 will also include a first exterior siding member 24 and a second exterior siding member 26. These two exterior siding members 24 and 26 are preferably oriented at 90 degrees with respect to one another when in the relaxed or non-flexed steady state condition. It has been found it is difficult to use such an exterior corner member configuration wherein exterior siding members 24 and 26 are perpendicular with respect to one another when being positioned over obtuse angles 20 of buildings 14 such as when used with bow windows as described above. As such, the present invention provides a novel means for uniformly and smoothly deforming the exterior corner member 12 or expanding the first exterior siding member 24 with respect to the second exterior siding member 26 in such a manner that an obtuse angle is defined therebetween.

With this configuration the vinyl siding corner member also includes a first attachment bracket 28 which includes a first attachment means 30 thereon to facilitate mounting of the first attachment bracket 28 and therefore the first exterior siding member 24 with respect to the first surface 16 of building 14. This first attachment means 30 can comprise a first flange 32 with a first hole means 34 extending therethrough. A plurality of nails 84 can be hammered through the first hole 34 by the vinyl siding installer to secure the first flange 32 with respect to the building 14.

In a similar manner a second attachment bracket 38 can be defined integrally with respect to the second exterior siding member 26 and can include a second attachment device 40 thereon to facilitate securement of the opposite side of the exterior corner member 12 with respect to the building 14. This second attachment means 40 may include a second flange 42 which defines one or more second holes 44 extending therethrough. The nails 84 can be hammered through the second hole 44 into the second surface 18 of building 14 to facilitate securement of the second flange 42 and therefore the second exterior siding member 26 with respect to the second surface 18 of building 14.

The first attachment bracket 28 will preferably define a first interior slot 36 facing inwardly into the clearance space 22 therein. In a similar manner the second attachment bracket 38 will preferably define a second interior slot 46 also facing inwardly toward the clearance space 22.

Also preferably the first attachment bracket 28 defines a first exterior slot 48 facing outwardly therefrom which is adapted to receive an adjacent piece of vinyl siding 10 for positioning therein. In a similar manner the second attachment bracket 38 will preferably define a second exterior slot 50 therein adapted to receive a conventional piece of vinyl siding 10 extending therein for mounting on the planar surface adjacent to the obtuse angle 20.

A plurality of expander members 52 are preferably included in the invention of the present design each of which includes a first arm means and a second arm means 68. First arm means 56 is adapted to extend into the first interior slot means 36 in such a manner as to be fixedly held therein. In a similar manner it is preferable that the second arm means 68 is adapted to be positioned extending into the second interior slot 46. With this configuration the angular relationship between the first arm 56 and the second arm 68 becomes a critically important value for the present invention. This angular relationship should preferably be greater than 90 degrees and can be of any chosen obtuse angle. By choosing of an expander member 52 with a first arm 56 and a second arm 68 oriented with respect to one another at an obtuse angle this pre-chosen obtuse angle will urge flexing movement of the first exterior siding member 24 and the second exterior siding member 26 in such a manner as to be oriented at the same obtuse angle with respect to one another as the relationship between the first arm means 56 and the second arm means 68.

Figure 6:
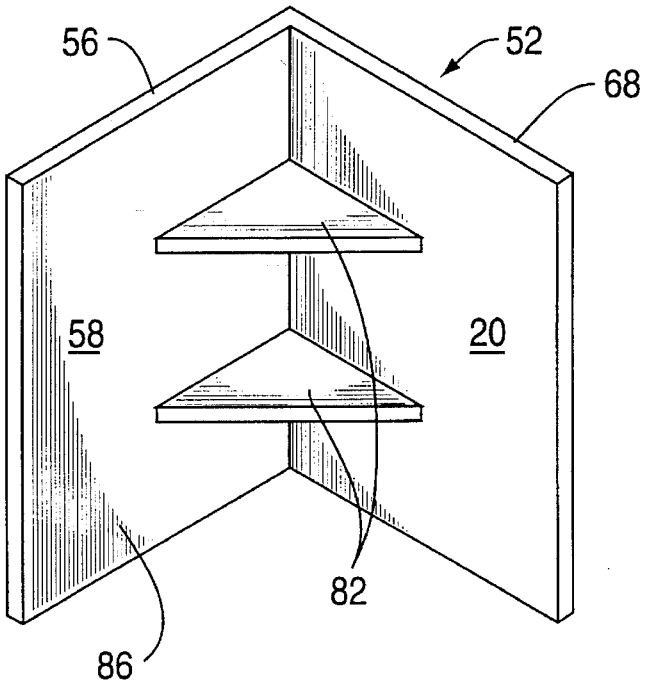
FIG. 6 is a perspective illustration of an embodiment of an expander member having a fixed angular relationship.

In one embodiment of the present invention a plurality of fixed expander members 86 can be included preferably of a similar configuration to that shown in FIG. 6 wherein the first and second arms 56 and 68 are oriented with respect to one another at a plurality of preset angles. These fixed expander members 86 can include cross members 82 extending between the first arm 56 and second arm 68 thereof to facilitate stability of the angular relationship therebetween. With the use of these designs if the obtuse angle 20 between the surfaces 16 and 18 is, for example, 120 degrees then a plurality in one or more such fixed expander members 86 pre-set at an obtuse angle of 120 degrees between the arms 56 and 68 thereof can be positioned within the clearance space 22. In this position the first arm 56 will extend into the first interior slot 36 and the second arm 68 will extend into the second interior slot 46 thereby flexing the vinyl material of the exterior corner member 12 to a position such that the exterior siding members 24 and 26 are angularly oriented with respect to one another at 120 degrees to form a smooth, non-distorted contour of an exterior corner extending over the obtuse surface angle 20. A number of such fixed expander members 86 can be positioned at various locations along the exterior corner member 12 but preferably there will be one located at approximately every two feet therealong to maintain a smooth, non-distorted external contour of the corner member 12.

In certain configurations the obtuse angle 20 between the first surface 16 and the second surface 18 of building 14 will not be an even or often used angle. For such configurations the present invention provides an adjustable expander member 88 which is designed to be movable to any pre-chosen angle as desired and then fixedly secured at that angle. Once the adjustable expander member 88 is fixedly secured to the desired angle, one or more such expander members can be used positioned within the clearance space 22 to expand the angular relationship between the exterior siding members 24 and 26 of the exterior corner member 12 to the desired angle. One or more such adjustable expander members 88 can be used in a similar manner to those of the fixed expander member 86. However, the adjustable expander member 88 provides the means for adjusting to any angle between 90 and 180 degrees or more often between 90 and 160 degrees.

In the configuration of the adjustable expander member 88 the first arm 56 will preferably include a first arm plate 58. The first arm plate 58 is the portion of the first arm 56 which actually extends into the first interior slot 36. In a similar manner the second arm 68 will include a second arm plate 70 which is the portion of the second arm 68 adapted to extend into the second interior slot 46 within the clearance space 22. The relative adjustable movement between the first arm 56 and the second arm 68 can be achieved by cooperative relationship between the first pivotal attachment means 60 of the first arm 56 and the second pivotal attachment means 72 of the second arm 68.

The first pivotal attachment means 60 of the first arm 56 includes a mounting aperture 62 therein as well as an alignment slot 66 therein. Preferably the alignment slot 66 is concentric with respect to the mounting aperture 62. The second arm 68 will preferably include an alignment ring 74 adapted to extend into the alignment slot 66 such as to maintain orientation therebetween the arms 56 and 68 during adjustment of the angular relationship therebetween. Also the second arm 68 will preferably include a mounting stud 76 with an enlarged mounting head 78 thereon adapted to extend through the mounting aperture 62 in the first arm 56 to facilitate pivotally movable attachment therebetween. The mounting head 78 of stud 76 will be larger than the inside diameter of the mounting aperture 62 and can be detachably engageable with respect to the mounting aperture 62 to facilitate pivotal connection therebetween. Head 78 can be forced through aperture 62 since the parts are preferably made of a flexibly resilient material such as vinyl. In this manner, the mounting stud 76 can be retained pivotally movable and in position extending through the mounting aperture 62.

Thus, the angular or pivotal movement of the first arm 56 with respect to the second arm 68 can be achieved. This movement is restricted to pivotal movement by the interengagement of the mounting stud 76 with respect to the mounting aperture 62 and the alignment ring 74 with respect to the alignment slot 66. Once the pre-chosen angle relationship between the first arm plate 58 and the second arm plate 70 is achieved, a fastening means 80 can be actuated to fixedly secure the first arm 56 with respect to the second arm 68 to prevent any further pivotal movement therebetween. Such a fastening means 80 can include a self-tapping screw means adapted to extend through fastening aperture 64 defined in the first pivotal attachment means 60 into engagement with the second pivotal attachment means 72 therebelow. The self-tapping screw means will actually extend through the fastening aperture 64 in the first arm 56 and will engage and self-tap themselves into securement with the second arm 68 positioned immediately therebelow. Once this fastening means 80 is activated the adjustable expander member 88 is affixed at the final obtuse angle between the arm means thereof and use is identical to that described above with the fixed expander member 86.

It should be appreciated that with the expander members 52 of the present invention positioned with the arms 56 and 68 thereof extending into the interior slots 36 and 46 a means will be provided for flexing the angular relationship between the surfaces of the vinyl siding corner member with respect to one another. These slot members 36 and 46 face inwardly toward the clearance space 22 and are adapted to receive the first arm plate 58 and the second arm plate 70 therein respectively. Movement of these plates through an angle with respect to one another will cause a similar angular movement of the exterior corner member 12 formed of flexible vinyl material.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An apparatus for forming vinyl siding corners extending over a first surface and a second surface intersecting at an obtuse angle, said apparatus comprising:

A. a vinyl siding corner member being flexibly resilient and including:

(1) an exterior corner member positioned extending over the first surface and the second surface and the obtuse angle of intersection therebetween, said exterior corner member along with the first surface and the second surface defining a clearance space means therebetween, said exterior corner member including:

(a) a first exterior siding member;

(b) a second exterior siding member attached to said first exterior siding member and extending outwardly therefrom at an angle resiliently biased to approximately ninety degrees, said first exterior siding member and said second exterior siding member with the first surface and the second surface defining said clearance space means there-adjacent and therebetween;

(2) a first attachment bracket being attached to said first exterior siding member and including:

(a) a first attachment means to facilitate securement of said first exterior siding member to the first surface;

(b) said first attachment bracket defining a first interior slot means positioned within said clearance space means and facing therein;

(3) a second attachment bracket being attached to said second exterior siding member and including:

(a) a second attachment means to facilitate securement of said second exterior siding member to the second surface;

(b) said second attachment bracket defining a second interior slot means positioned within said clearance space means and facing therein;

B. at least one expander member positionable within said clearance space means and extending into said first interior slot means and said second interior slot means, each said expander member including:

(1) a first arm means positioned extending into said first interior slot means; and (2) a second arm means attached to said first arm means and extending outwardly therefrom into said second interior slot means, said second arm means extending outwardly from said first arm means at an obtuse angle approximately equal to the obtuse angle of intersection between said first surface and said second surface to urge said exterior corner member of flexibly resilient material to flex to a position with said first exterior siding member and said second exterior siding member angularly oriented obtusely with respect to one another to extend over the first surface and the second surface and the obtuse intersecting angle therebetween.

2. An apparatus for forming vinyl siding corners extending over a first surface and a second surface intersecting at an obtuse angle as defined in claim 1 wherein each said expander member further includes a cross member secured to said first arm means and said second arm means and extending therebetween for reinforcement thereof.

3. An apparatus for forming vinyl siding corners extending over a first surface and a second surface intersecting at an obtuse angle as defined in claim 1 wherein said first arm means and said second arm means are oriented with respect to one another at an angle greater than ninety degrees and less than one hundred sixty degrees.

4. An apparatus for forming vinyl siding corners extending over a first surface and a second surface intersecting at an obtuse angle as defined in claim 1 wherein said first arm means is movably secured to said second arm means to facilitate adjustment of relative positioning therebetween.

5. An apparatus for forming vinyl siding corners extending over a first surface and a second surface intersecting at an obtuse angle as defined in claim 4 wherein said first arm means is pivotally secured to said second arm means to facilitate adjustment of relative positioning therebetween.

6. An apparatus for forming vinyl siding corners extending over a first surface and a second surface intersecting at an obtuse angle as defined in claim 4 wherein said expander member further includes a securement means for fixedly securing said first arm means with respect to said second arm means.

7. An apparatus for forming vinyl siding corners extending over a first surface and a second surface intersecting at an obtuse angle as defined in claim 6 wherein said securement means includes self-tapping screw means.

8. An apparatus for forming vinyl siding corners extending over a first surface and a second surface intersecting at an obtuse angle as defined in claim 1 wherein said expander member comprises:

A. said first arm means including:

(1) a first arm plate positionable extending into said first interior slot means;

(2) a first pivotal attachment means positioned spatially disposed on said first arm means from said first arm plate and defining a mounting aperture means therein;

B. said second arm means including:

(1) a second arm plate positionable extending into said second interior slot means at an obtuse angle with respect to said first arm plate;

(2) a second pivotal attachment means positioned spatially disposed on said second arm means from said second arm plate, said second pivotal attachment means being engageable with respect to said first pivotal attachment means to pivotally secure said first arm means with respect to said second arm means, said second pivotal attachment means including a mounting stud means adapted to extend through said mounting aperture means defined in said first pivotal attachment means to facilitate pivotal movement of said first arm means with respect to said second arm means;

C. a fastening means adapted to fixedly secure said first pivotal attachment means of said first arm means with respect to said second pivotal attachment means of said second arm means after selective adjustment therebetween to a desired obtuse angle relative therebetween.

9. An apparatus for forming vinyl siding corners extending over a first surface and a second surface intersecting at an obtuse angle as defined in claim 8 further comprising an enlarged head means fixedly mounted on said mounting stud means extending through said mounting aperture means to maintain engagement therebetween during relative pivotal movement therebetween.

10. An apparatus for forming vinyl siding corners extending over a first surface and a second surface intersecting at an obtuse angle as defined in claim 8 wherein said fastening means comprises self-tapping screw means.

11. An apparatus for forming vinyl siding corners extending over a first surface and a second surface intersecting at an obtuse angle as defined in claim 8 wherein said first pivotal attachment means defines a fastening aperture means extending therethrough and includes a self-tapping screw means adapted to extend through said fastening aperture means into engagement with said second pivotal attachment means to comprise said fastening means and for fixedly securing said first arm means with respect to said second arm means after selective adjustment to a desired obtuse angle relative therebetween.

12. An apparatus for forming vinyl siding corners extending over a first surface and a second surface intersecting at an obtuse angle as defined in claim 8 wherein said first arm means includes an alignment slot means therein and wherein said second arm means includes an alignment ring means adapted to extend into said alignment slot means for movable engagement therewith to maintain alignment between said first arm means and said second arm means during relative pivotal movement therebetween.

13. An apparatus for forming vinyl siding corners extending over a first surface and a second surface intersecting at an obtuse angle as defined in claim 12 wherein said alignment slot means is concentric with respect to said mounting aperture means.

14. An apparatus for forming vinyl siding corners extending over a first surface and a second surface intersecting at an obtuse angle as defined in claim 1 wherein first exterior siding member and said second exterior siding member are integrally formed with respect to one another to integrally form said exterior corner member.

15. An apparatus for forming vinyl siding corners extending over a first surface and a second surface intersecting at an obtuse angle as defined in claim 1 wherein said first exterior siding member and said first attachment bracket are integrally formed with respect to one another and wherein said second exterior siding member and said second attachment bracket are integrally formed with respect to one another.

16. An apparatus for forming vinyl siding corners extending over a first surface and a second surface intersecting at an obtuse angle as defined in claim 1 wherein said first attachment means of said first attachment bracket includes a first flange means defining a first hole means extending therethrough to facilitate securement of said first exterior siding member with respect to the first surface and wherein said second attachment means of said second attachment bracket includes a second flange means defining a second hole means extending therethrough to facilitate securement of said second exterior siding member with respect to the second surface.

17. An apparatus for forming vinyl siding corners extending over a first surface and a second surface intersecting at an obtuse angle as defined in claim 1 wherein a plurality of said expander members are positioned within said clearance space means along said exterior corner member spaced apart from one another at intervals of approximately two feet therealong.

18. An apparatus for forming vinyl siding corners extending over a first surface and a second surface intersecting at an obtuse angle as defined in claim 1 wherein each expander member is adapted to spread said first exterior siding member and said second exterior siding means outwardly with respect another to a obtuse angle relative therebetween sufficient to position said first exterior siding member extending approximately parallel with respect to the first surface and to position said second exterior siding member extending approximately parallel with respect to the second surface.

19. An apparatus for forming vinyl siding corners extending over a first surface and a second surface intersecting at an obtuse angle between ninety degrees and one hundred sixty degrees, said apparatus comprising:

A. a vinyl siding corner member being flexibly resilient and including:

(1) an exterior corner member positioned extending over the first surface and the second surface and the obtuse angle of intersection therebetween, said exterior corner member along with the first surface and the second surface defining a clearance space means therebetween, said exterior corner member including:

(a) a first exterior siding member;

(b) a second exterior siding member integral with respect to said first exterior siding member and extending outwardly therefrom at an angle resiliently biased to approximately ninety degrees, said first exterior siding member and said second exterior siding member with the first surface and the second surface defining said clearance space means thereadjacent and therebetween;

(2) a first attachment bracket being integral with said first exterior siding member and including:

(a) a first attachment means to facilitate securement of said first exterior siding member to the first surface, said first attachment means including a first flange means defining a first hole means extending therethrough to facilitate securement of said first exterior siding member with respect to the first surface;

(b) said first attachment bracket defining a first interior slot means positioned within said clearance space means and facing therein;

(3) a second attachment bracket being integral with said second exterior siding member and including:

(a) a second attachment means to facilitate securement of said second exterior siding member to the second surface, said second attachment means including a second flange means defining a second hole means extending therethrough to facilitate securement of said second exterior siding member with respect to the second surface;

(b) said second attachment bracket defining a second interior slot means positioned within said clearance space means and facing therein;

B. a plurality of expander members positionable within said clearance space means spaced approximately two feet apart and extending into said first interior slot means and said second interior slot means to facilitate flexible movement of said exterior corner member such that said first exterior siding member and said second exterior siding member are oriented at an obtuse angle between ninety degrees and one hundred sixty degrees with respect to one another, each said expander member including:

(1) a first arm means including:

(a) a first arm plate positionable extending into said first interior slot means;

(b) a first pivotal attachment means positioned spatially disposed on said first arm means from said first arm plate and defining a mounting aperture means therein, said first pivotal attachment means further defining a fastening aperture means therein, said first pivotal attachment means further defining an alignment slot means therein being concentric with respect to said mounting aperture means;

(2) a second arm means including:

(a) a second arm plate positionable extending into said second interior slot means at an obtuse angle of between ninety degrees and one hundred sixty degrees with respect to said first arm plate;

(b) a second pivotal attachment means positioned spatially disposed on said second arm means from said second arm plate, said second pivotal attachment means being engageable with respect to said first pivotal attachment means to pivotally secure said first arm means with respect to said second arm means, said second pivotal attachment means defining an alignment ring means therein adapted to extend into said alignment slot means for movable engagement therewith to maintain alignment between said first arm means and said second arm means during relative pivotal movement therebetween, said second pivotal attachment means including:

(i) a mounting stud means adapted to extend through said mounting aperture means defined in said first pivotal attachment means to facilitate pivotal movement of said first arm means with respect to said second arm means;

(ii) a enlarged head means fixedly secured to said mounting stud means extending through said mounting aperture means to maintain engagement therebetween during relative pivotal movement between said first arm means and said second arm means for adjustment of angular positioning therebetween; and (3) a fastening means adapted to selectively fixedly secure said first pivotal attachment means of said first arm means with respect to said second pivotal attachment means of said second arm means after selective adjustment therebetween to a desired obtuse angle relative therebetween such that said first exterior siding member is approximately parallel to the first surface and said second exterior siding member is approximately parallel to the second surface, said fastening means including a self-tapping screw means adapted to extend through said fastening aperture means into engagement with said second pivotal attachment means for fixedly securing said first arm means with respect to said second arm means after selective adjustment to a desired obtuse angle relative therebetween.

20. An expander apparatus with a formed vinyl siding exterior corner positioned extending over a first surface and a second surface intersecting at an obtuse angle, the formed vinyl siding exterior corner including:

A. a vinyl siding corner member being flexibly resilient and including:

(1) an exterior corner member positioned extending over the first surface and the second surface and the obtuse angle of intersection therebetween, the exterior corner member along with the first surface and the second surface defining a clearance space means therebetween, the exterior corner member including:

(a) a first exterior siding member;

(b) a second exterior siding member attached with respect to the first exterior siding member and extending outwardly therefrom at an angle resiliently biased to approximately ninety degrees, the first exterior siding member and the second exterior siding member with the first surface and the second surface defining the clearance space means thereadjacent and therebetween;

(2) a first attachment bracket being attached to the first exterior siding member and including:

(a) a first attachment means to facilitate securement of the first exterior siding member to the first surface;

(b) the first attachment bracket defining a first interior slot means positioned within the clearance space means and facing therein;

(3) a second attachment bracket being attached to the second exterior siding member and including:

(a) a second attachment means to facilitate securement of the second exterior siding member to the second surface;

(b) the second attachment bracket defining a second interior slot means positioned within the clearance space means and facing therein;

the expander apparatus comprising at least one expander member positionable within the clearance space means and extending into the first interior slot means and the second interior slot means, each said expander member including:

B. a first arm means positioned extending into the first interior slot means; and C. a second arm means attached to said first arm means and extending outwardly therefrom into the second interior slot means, said second arm means extending outwardly from said first arm means at an obtuse angle approximately equal to the obtuse angle of intersection between the first surface and the second surface to urge the exterior corner member of flexibly resilient material to flex to a position with the first exterior siding member and the second exterior siding member angularly oriented obtusely with respect to one another to extend over the first surface and the second surface and the obtuse intersecting angle therebetween.

* * * * *